US011812915B2

(12) United States Patent
Lölsberg

(10) Patent No.: US 11,812,915 B2
(45) Date of Patent: Nov. 14, 2023

(54) CLEANING DEVICE FOR FOOD VESSELS

(71) Applicant: Bernd Lölsberg, Kürnach (DE)

(72) Inventor: Bernd Lölsberg, Kürnach (DE)

( * ) Notice: Subject to any disclaimer, the term of this patent is extended or adjusted under 35 U.S.C. 154(b) by 374 days.

(21) Appl. No.: 17/261,051

(22) PCT Filed: Jun. 27, 2019

(86) PCT No.: PCT/EP2019/067149
§ 371 (c)(1),
(2) Date: Mar. 2, 2021

(87) PCT Pub. No.: WO2020/015973
PCT Pub. Date: Jan. 23, 2020

(65) Prior Publication Data

US 2021/0259513 A1 Aug. 26, 2021

(30) Foreign Application Priority Data

Jul. 19, 2018 (DE) ..... 20 2018 104 170.3

(51) Int. Cl.

| | |
|---|---|
| ***A47L 15/00*** | (2006.01) |
| ***A47L 15/42*** | (2006.01) |
| ***A47L 15/44*** | (2006.01) |
| ***A47L 17/00*** | (2006.01) |
| ***B08B 9/093*** | (2006.01) |

(52) U.S. Cl.
CPC ..... *A47L 17/00* (2013.01); *A47L 15/0065* (2013.01); *A47L 15/4278* (2013.01); *A47L 15/4418* (2013.01); *B08B 9/0936* (2013.01)

(58) Field of Classification Search
None
See application file for complete search history.

(56) References Cited

U.S. PATENT DOCUMENTS 2,665,440 A 1/1954 Starcevich

FOREIGN PATENT DOCUMENTS

| | | | |
|---|---|---|---|
| DE | 3131333 | A1 | 2/1983 |
| DE | 202005015103 | U1 | 2/2006 |
| DE | 2020060008837 | U1 | 8/2006 |
| FR | 624156 | A | 7/1927 |

*Primary Examiner* — Levon J Shahinian
(74) *Attorney, Agent, or Firm* — Dickinson Wright PLLC; Andrew D. Dorisio

(57) ABSTRACT

The invention relates to a cleaning device (01) for food vessels, in particular mixing containers or mixing container parts, in which cleaning liquid is supplied to a valve support (11) and is conveyed through at least one rinsing rod (03), the rinsing rod (03) being disposed in an upwardly open receptacle (02), and an actuating device (09) controlling the flow rate of the cleaning liquid from the valve support (11) into the rinsing rod (03) by means of a valve in the valve support (11), and the rinsing rod (03) having at least one horizontal nozzle (07) for cleaning an inner circumferential surface (08) of the food vessel (04), and the rinsing rod (03) having at least one vertical nozzle (06) for cleaning a bottom surface of the food vessel, the cleaning device (01) being provided with a blocking device (05) which prevents cleaning liquid from exiting through the vertical nozzle (06) and/or the horizontal nozzle (07).

11 Claims, 6 Drawing Sheets

CLEANING DEVICE FOR FOOD VESSELS

FIELD OF THE INVENTION

The invention relates to a cleaning device for food vessels, in particular mixing containers or mixing container parts, according to the preamble of claim 1.

BACKGROUND OF THE INVENTION

A generic cleaning device is known from DE 20 2005 015 103 U1, for example. Being a generic cleaning device, it comprises a rinsing rod which is disposed in an upwardly open receptacle. An actuating device can control a valve in a valve support in order to regulate the flow rate of the cleaning liquid from the valve support into the rinsing rod. The rinsing rod itself is provided with horizontal nozzles for cleaning the inner circumferential surface of the food vessel and vertical nozzles for cleaning the bottom surface of the food vessel.

When a vessel is cleaned in a generic cleaning device, the cleaning liquid, for example water, is rinsed through the horizontal nozzles onto the inner circumferential surface of the vessel and thus, the inner circumference of the vessel is cleaned. Simultaneously, the cleaning liquid is rinsed through the vertical nozzles onto the bottom surface of the food vessel and thus, the bottom surface is cleaned.

The known cleaning devices are disadvantageous in the sense that portioning vessels, in particular mixing container parts without a bottom, cannot be cleaned. Since no bottom is present, the cleaning fluid would exit upwards upon emerging from the vertical nozzles and would cause a contamination or drenching of the environment. This problem occurs in particular when cleaning mixing container parts, which are used for mixing mixed drinks using disposable containers. When mixing the mixed drink, these mixing container parts are put over the lateral surface of the disposable container and form a sturdy vessel rim and a sturdy vessel wall during the mixing. At the end of the mixing process, the disposable container having the mixed drink is removed and, after an appropriate cleaning, the mixing container shell can be used along with a succeeding disposable container for mixing a mixed drink. The known cleaning devices are not suitable for cleaning such mixing container shells because the mixing container shells do not have a bottom. This is because the bottom is realized by the bottom of the disposable container which is no longer present during the cleaning of the mixing container shell.

SUMMARY OF THE INVENTION

The object of the present invention is to propose a cleaning device for food vessels in which food vessels with and without a bottom can be cleaned according to choice.

This object is attained by a cleaning devices according to the teachings as disclosed herein.

Advantageous embodiments of the invention are the subject matter of the dependent claims.

The cleaning device according to the invention is based on the idea that the cleaning device is provided with a blocking device which prevents cleaning liquid from exiting through the vertical nozzles and/or the horizontal nozzles. By activating the blocking device, water can be prevented from exiting through the vertical nozzles or the horizontal nozzles, such that vessels without a bottom can easily be cleaned by means of the water exiting through the horizontal nozzles, without water uncontrollably being spouted upwards. In turn, if a vessel with a bottom is to be cleaned afterwards, the blocking device can be opened such that the cleaning liquid in turn exits through the vertical nozzles and ensures an appropriate cleaning of the bottom surface of the vessel. If only the bottom of a vessel is to be cleaned while the inner circumference is not to be cleaned, the horizontal nozzles can be blocked such that the cleaning liquid can exit through the vertical nozzles only.

In general, any design can be used for realizing the blocking device. For example, valves which can block the supply of the cleaning liquid to the vertical nozzles and/or the horizontal nozzles can be envisaged for this. Alternatively, a particularly simple solution is to realize the blocking device in the manner of a blocking member which is mounted so as to be adjustable on the rinsing rod. The blocking member itself can be adjusted between an open position and a blocking position. The blocking member is provided with passage openings such that, when the blocking member is in the open position, the cleaning liquid can exit and clean the bottom surface of the vessel to be cleaned. In contrast, when the blocking member is in the blocking position, the vertical nozzles and/or the horizontal nozzles are covered by the wall of the blocking member such that the cleaning liquid can be prevented from exiting upwards through the horizontal nozzles.

In general, any design can be used for mounting the blocking member on the rinsing rod and for disposing it so as to be adjustable between the open position and the blocking position. According to a preferred embodiment, the blocking member has at least two attachment arms which engage at least partly around the lateral surface of the rinsing rod. The rinsing rod itself is provided with one recess in which fixing protrusions, which are formed on the attachment arms, can engage in a fixing manner.

In general, any geometrical design can be used for realizing the recess for fixing the blocking member on the rinsing rod. Preferably, said recess should be realized in the manner of an attachment groove which is disposed on the circumference of the rinsing rod, the blocking members having the attachment arms, which engage in the attachment groove, being mounted so as to be rotatable on the rinsing rod in this manner. By rotating the blocking member relative to the rinsing rod, the user can put the blocking member into the open position or into the blocking position according to choice in order to clean food vessels with and without a bottom using the cleaning device according to the invention.

For using the cleaning device according to the invention in the most uncomplicated manner possible, it is advantageous if the user can easily set the blocking position or the open position of the blocking member. This can easily be achieved by forming at least one blocking end stop or one rinsing end stop on the attachment groove. In this case, the blocking end stop defines the blocking position of the blocking member, such that the blocking position of the blocking member can easily be set by rotating the blocking member to the blocking end stop. In contrast, the rinsing end stop of the attachment groove defines the open position of the blocking member, such that the horizontal nozzle can easily be opened by rotating the blocking member to the rinsing end stop.

How many vertical nozzles and/or horizontal nozzles are provided on the rinsing rod for cleaning the bottom surface of a food vessel depends on the particular use. By increasing the number of the vertical nozzles and/or the horizontal nozzles, the cleaning efficiency can be increased. If several vertical nozzles and/or several horizontal nozzles are provided for jointly cleaning the bottom surface of the food vessel, each vertical nozzle and/or horizontal nozzle is assigned one section of the blocking member by means of which cleaning liquid can be prevented from exiting through the assigned vertical nozzle and/or horizontal nozzle by disposing the blocking member in the blocking position. Additionally, for each vertical nozzle and/or horizontal nozzle, the blocking member has one recess through which the cleaning liquid can exit upwards or sideways when the blocking member is disposed in the open position and can cause the cleaning of the bottom surface and/or the inner circumferential surface of the food vessel.

For facilitating the adjustment of the blocking member between the blocking position and the open position, it is advantageous for the blocking member to be provided with an actuating element for manual adjustment.

Furthermore, in view of the necessary hygiene and the thus regularly required cleaning of the entire cleaning device, it is especially advantageous for the blocking member to be detachably mounted on the rinsing rod. In this manner, the blocking member can easily be dismounted for cleaning and, after cleaning, can be remounted on the rinsing rod.

For the blocking member to be easily dismountable from the rinsing rod, it is advantageous for the attachment groove to have one recess for each fixing protrusion by means of which the fixing protrusions can be removed from the attachment groove and, in the course of remounting the blocking member on the rinsing rod, can be inserted again into said attachment groove.

In order to further facilitate mounting or dismounting of the blocking member on the rinsing rod, it is particularly advantageous for the attachment groove to have at least one assembly stop. This assembly stop defines the assembly position of the blocking member in which the fixing protrusions can be removed from the attachment groove and, in the course of remounting the blocking member, can be inserted again into said attachment groove.

BRIEF DESCRIPTION OF THE DRAWING FIGURES

An embodiment of the invention is schematically illustrated in the drawings and is described in an exemplary manner hereinafter.

DETAILED DESCRIPTION OF THE INVENTION

Figure 1:
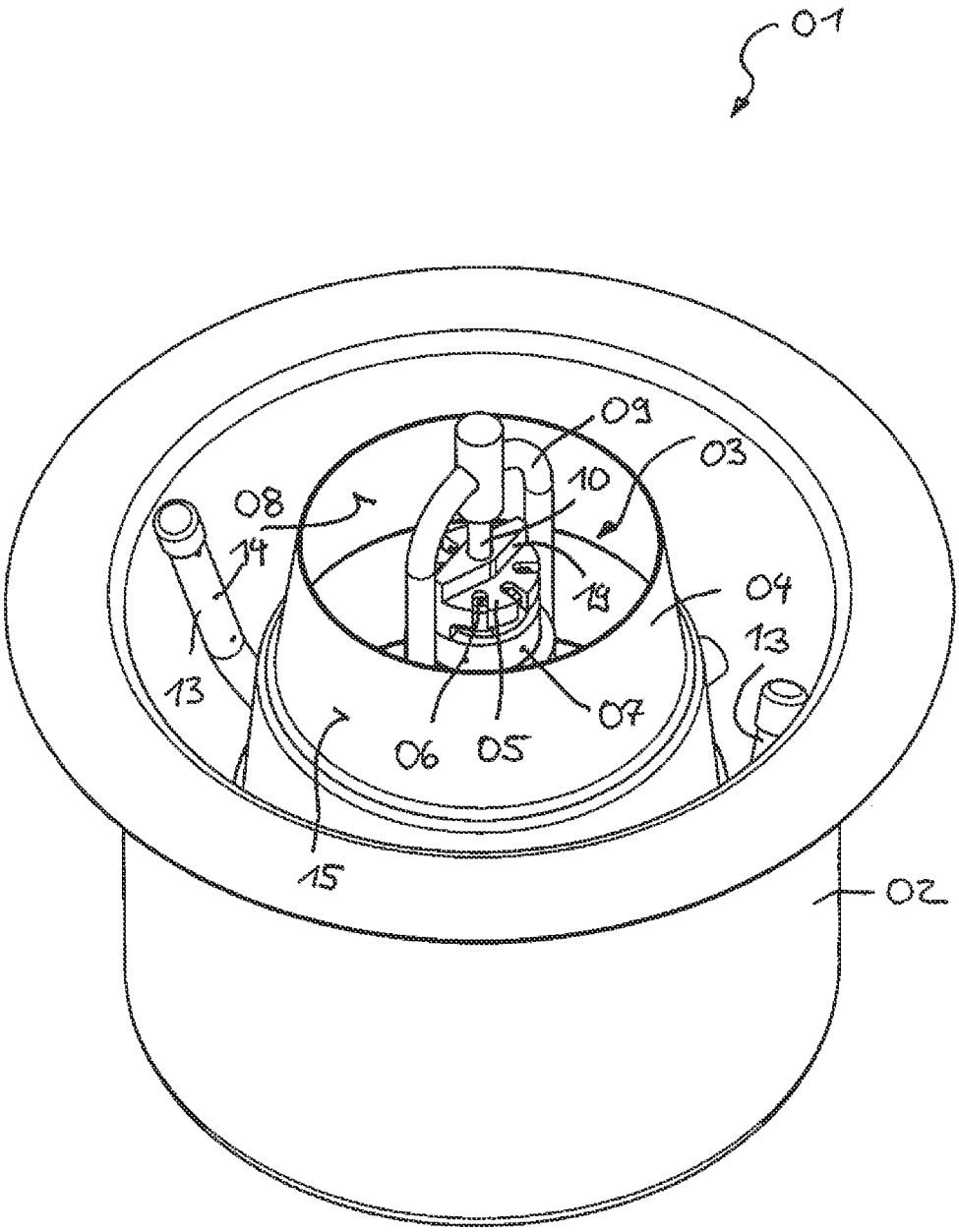
FIG. 1 shows a cleaning device according to the invention in a perspective top view.
Figure 2:
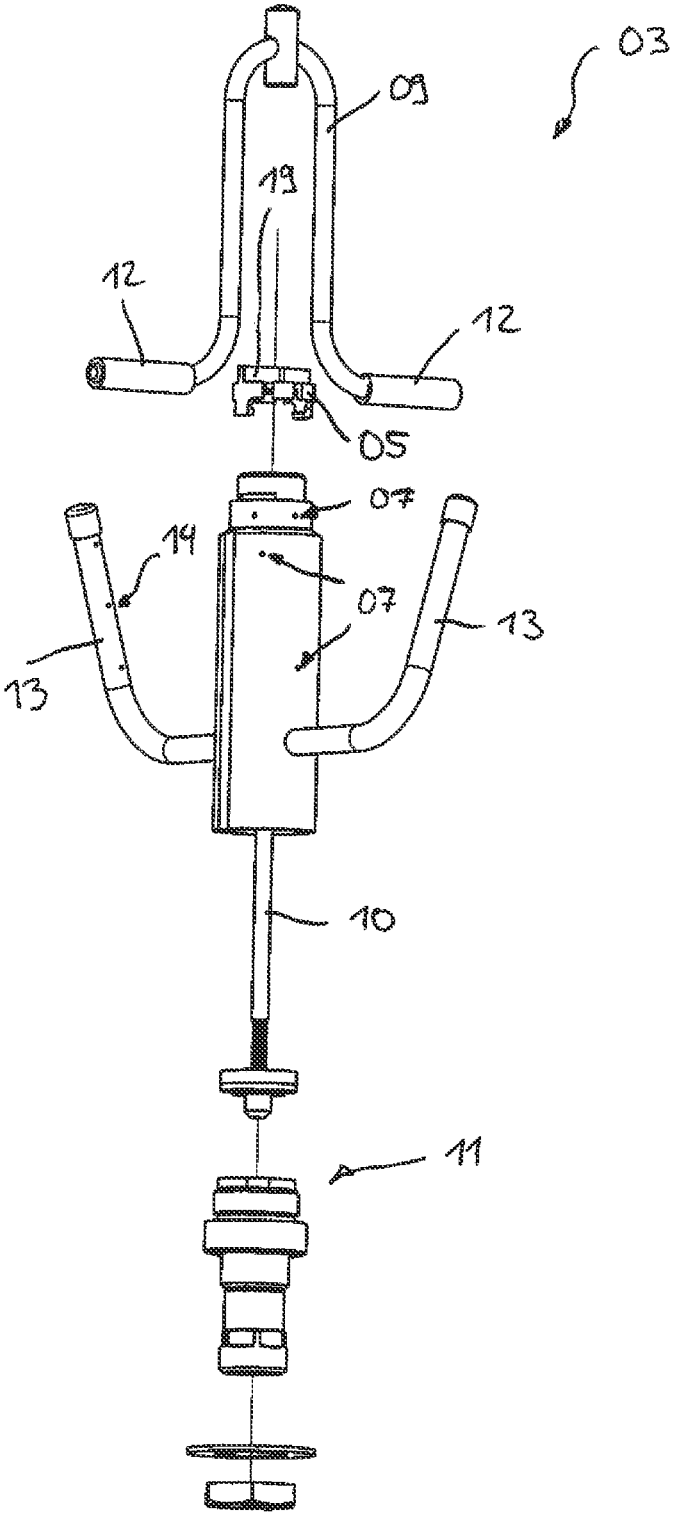
FIG. 2 shows the rinsing rod of the cleaning device according to FIG. 1 in an exploded view.

FIG. 1 shows a cleaning device 01 according to the invention in a perspective top view. The cleaning device 01 comprises an upwardly open receptacle 02 serving to collect cleaning liquid and a rinsing rod 03 serving to distribute the cleaning liquid.

Food vessels with and without a bottom can be cleaned according to choice in cleaning device 01. In FIG. 1, a food vessel 04 without a bottom, which is a mixing container shell used for producing mixed drinks, is shown in an exemplary manner. This mixing container shell serves the purpose of being put over disposable containers in order to allow the mixed drink to be mixed in the disposable container and to ensure a sturdy wall during the mixing process by means of the mixing container shell. On the upper end of rinsing rod 03, a blocking member 05 is provided which can prevent cleaning liquid from exiting through vertical nozzles 06. Vertical nozzles 06 are disposed in such a manner on the front face of rinsing rod 03 that they spray the cleaning liquid vertically upwards when blocking member 05 is in its open position and cause a cleaning of the bottom surface of a food vessel having a bottom surface (not shown in the drawings). On the circumference of rinsing rod 03, several horizontal nozzles 07 are provided through which the cleaning liquid exits horizontally and thus causes a cleaning of the inner circumferential surface 08 of food vessel 04. As explained above, food vessel 04 does not comprise a bottom, such that when rinsing rod 03 is used in the arrangement schematically shown in FIG. 1, the water would exit upwards over the rim of the receptacle and would cause undesired spouting. To prevent this, blocking member 05, which is shown in its open position in FIG. 1, can be put into a blocking position by rotating it relative to rinsing rod 03, vertical nozzles 06 being blocked in said blocking position in such a manner that a food vessel 04 without a bottom can also be cleaned easily without cleaning liquid exiting.

Figure 3:
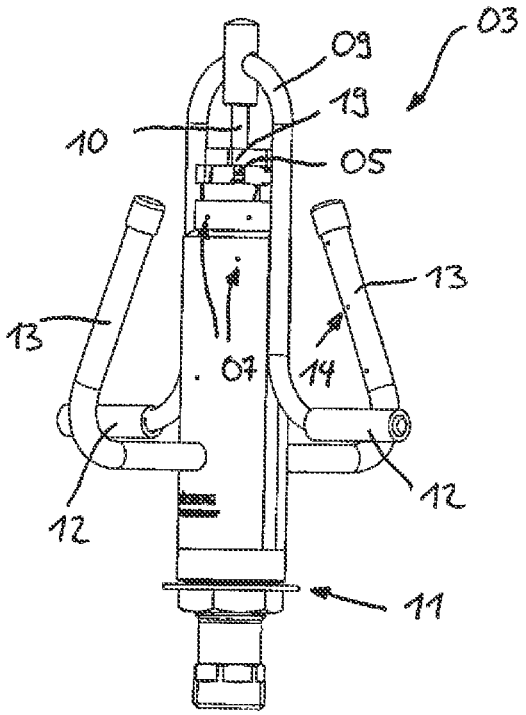
FIG. 3 shows the rinsing rod according to FIG. 2 in the assembled state in a side view.

FIG. 3 shows rinsing rod 03 in a side view. Various horizontal nozzles 07 for cleaning the inner circumferential surface of food vessel 04 can be seen. To control the flow rate of the cleaning liquid, a detachable actuating device 09 is provided, which can control the valve for controlling the flow rate of the cleaning liquid in a valve support 11 by means of a rod element 10. Actuating device 09 comprises two laterally protruding arms 12 with which the rim of food vessel 04 to be cleaned can come into contact, such that the valve in valve support 11 can be opened by means of pressure from the top which is conveyed via actuating device 09 and rod 10 onto food vessel 04, such that the pressurized cleaning liquid is conveyed to vertical nozzles 06 or horizontal nozzles 07. Additionally, the cleaning liquid also flows through two lateral cleaning arms 13 and valve nozzles 14 provided therein in order to clean outer circumferential surface 15 of food vessel 04 in this manner.

Figure 4:
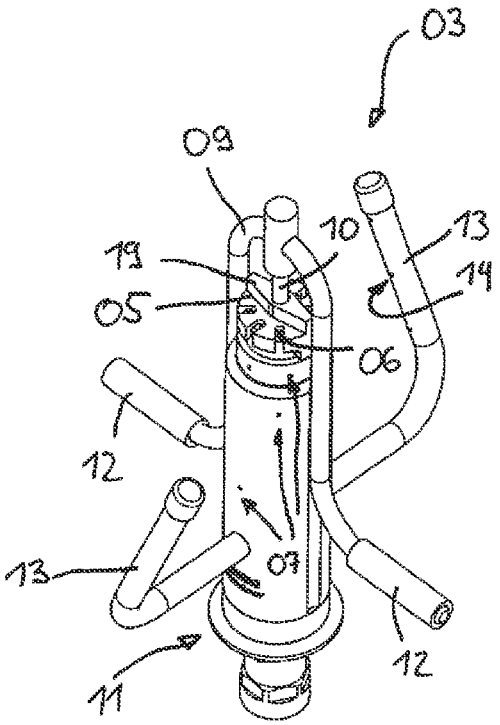
FIG. 4 shows the rinsing rod according to FIG. 2 in a perspective top view.

FIG. 4 shows rinsing rod 03 having blocking member 05 in its open position in a perspective top view.

Figure 5:
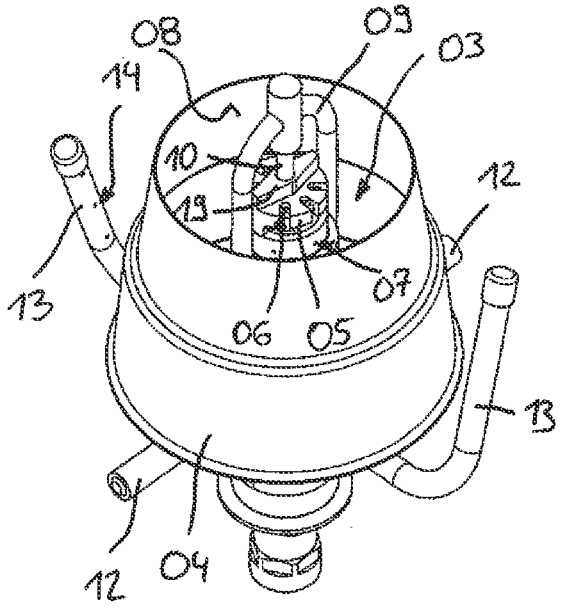
FIG. 5 shows the rinsing rod according to FIG. 4 when a food vessel to be cleaned is disposed on the actuating device.

FIG. 5 shows rinsing rod 03 after positioning food vessel 04 to be cleaned onto arms 12 of actuating device 09 in a perspective top view.

Figure 6:
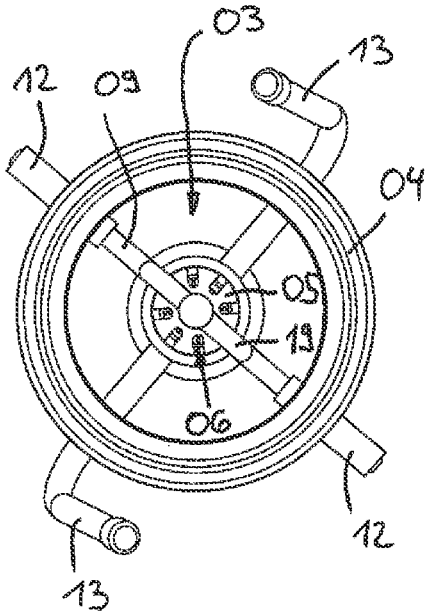
FIG. 6 shows the rinsing rod having the food vessel to be cleaned according to FIG. 5 in a top view.

FIG. 6 shows rinsing rod 03 having food vessel 04 and blocking member 05 in a top view. In the illustrated position of blocking member 05, it is disposed in its open position, such that vertical nozzles 06 are not covered by blocking member 05. In this position, the cleaning liquid would exit through vertical nozzles 06 upon actuation of actuating device 09 and would cause a contamination of the environment with cleaning liquid.

Figure 7:
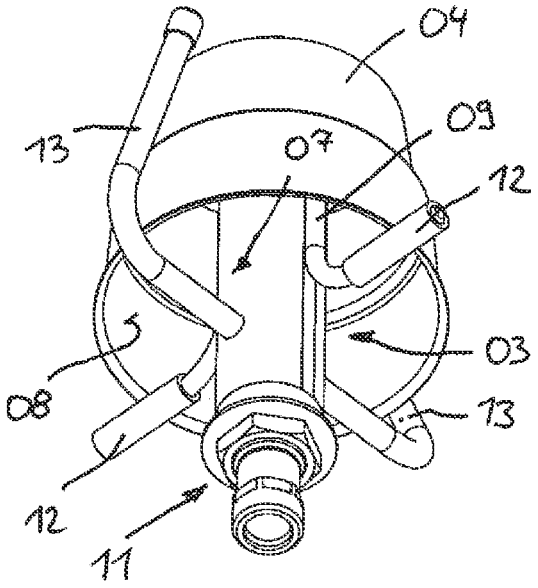
FIG. 7 shows the rinsing rod having the food vessel to be cleaned according to FIG. 5 in a perspective bottom view.

FIG. 7 shows rinsing rod 03 having food vessel 04 in a perspective bottom view.

The function of blocking member 05 when it is disposed in its open position, its blocking position and its assembly position is explained in further detail by means of the drawings in FIG. 8, FIG. 9 and FIG. 10 in the following.

Figure 8:
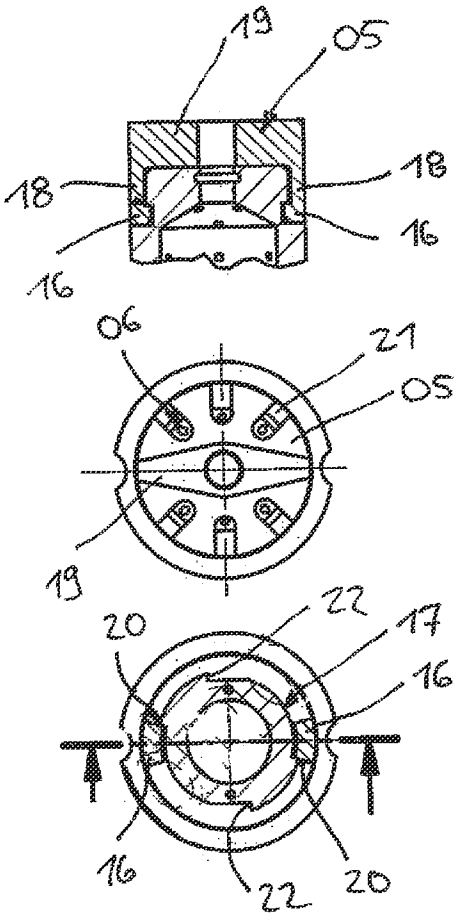
FIG. 8 shows the rinsing rod having the blocking member which is disposed in the cleaning position in longitudinal section, in a top view and in cross section.

FIG. 8 shows blocking member 05 in its open position, blocking member 05 and rinsing rod 03 being consecutively illustrated from top to bottom in longitudinal section, in a top view or in cross section. As can be seen in the longitudinal section of blocking member 05 (shown at the top), blocking member 05 having two fixing protrusions 16 engages in an attachment groove 17 on the upper end of rinsing rod 03 in a fixing manner. Fixing protrusions 16 are formed in one piece on blocking member 05 by means of two attachment arms 18.

As can be seen from the top in the middle view, an actuating element 19 on which blocking member 05 can be manually rotated relative to rinsing rod 03 by the user is formed on the upper surface of blocking member 05. In the position shown in FIG. 8, the blocking member is in its open position and vertical nozzles 06 are open, such that the cleaning liquid can exit upwards. This open position is defined by two rinsing end stops 20 in attachment groove 17.

Figure 9:
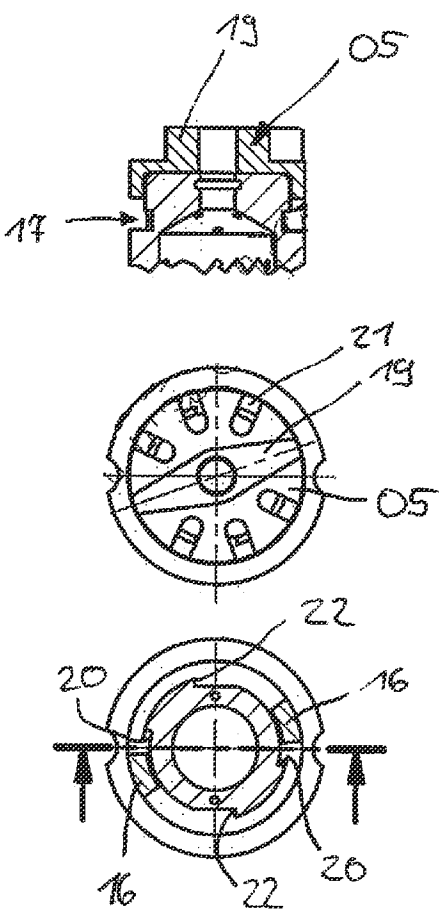
FIG. 9 shows the rinsing rod having the blocking member which is disposed in the blocking position in longitudinal section, in a top view and in cross section.

FIG. 9 shows blocking member 05 in its blocking position. By rotating blocking member 05 on actuating element 19, openings 21 in the blocking member, through which the cleaning liquid can exit, are adjusted to such an extent that horizontal nozzles 07 are covered. In this blocking position of blocking member 05, a food vessel 04 without a bottom can also be cleaned easily because the cleaning liquid is prevented from exiting upwards through horizontal nozzles 07.

Figure 10:
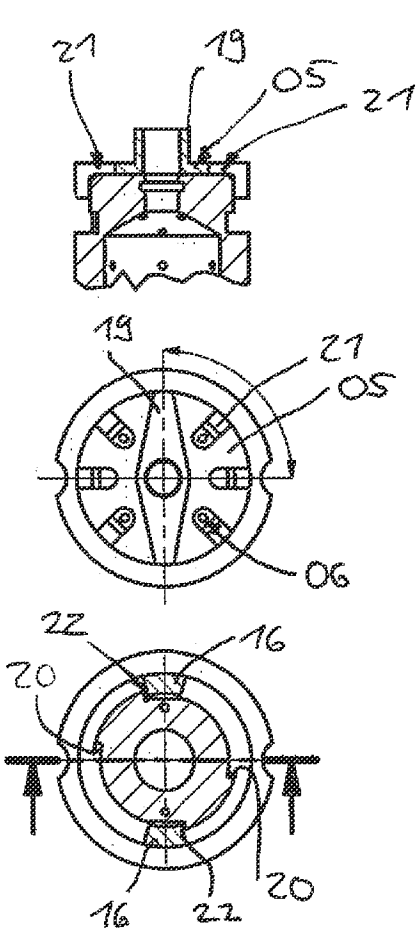
FIG. 10 shows the rinsing rod having the blocking member which is disposed in the assembly position in longitudinal section, in a top view and in cross section.

FIG. 10 shows blocking member 05 in its assembly position which is defined by an assembly stop 22. When the two fixing protrusions 16 come into contact with the two assembly stops 22, the blocking member is in a position in which the two fixing protrusions 16 can be removed upwards by means of two recesses extending vertically upwards.

The invention claimed is:

1. A cleaning device (01) for food vessels, in which cleaning liquid is supplied to a valve support (11) and is conveyed through at least one rinsing rod (03), the rinsing rod (03) being disposed in an upwardly open receptacle (02), and an actuating device (09) controlling the flow rate of the cleaning liquid from the valve support (11) into the rinsing rod (03) by means of a valve in the valve support (11), and the rinsing rod (03) having at least one horizontal nozzle (07) for cleaning an inner circumferential surface (08) of the food vessel (04), and the rinsing rod (03) having at least one vertical nozzle (06) for cleaning a bottom surface of the food vessel, characterized in that the cleaning device (01) is provided with a blocking device (05) which prevents cleaning liquid from exiting through the vertical nozzle (06) and/or the horizontal nozzle (07), wherein the blocking device is realized in the manner of a blocking member (05) which is mounted so as to be adjustable on the rinsing rod and which is adjustable between an open position and a blocking position, the blocking member (05) blocking the vertical nozzle (06) and/or the horizontal nozzle (07) when in the blocking position, and the vertical nozzle (06) and/or the horizontal nozzle (07) being open when the blocking member (05) is in the open position.

2. The cleaning device according to claim 1, characterized in that the blocking member (05) has at least two attachment arms (18) which engage at least partly around the lateral surface of the rinsing rod (03), the rinsing rod (03) being provided with at least one recess in which fixing protrusions (16), which are formed on the attachment arms (18), engage in a fixing manner.

3. The cleaning device according to claim 2, characterized in that the recess is realized in the manner of an attachment groove (17) which is disposed on the circumference of the rinsing rod (03), the blocking member (05) having the fixing protrusions (16), which engage in the attachment groove (17), being mounted so as to be rotatable on the rinsing rod (03).

4. The cleaning device according to claim 3, characterized in that at least one blocking end stop is formed on the attachment groove (17), the blocking end stop defining the blocking position of the blocking member (05).

5. The cleaning device according to claim 3, characterized in that at least one rinsing end stop (20) is formed on the attachment groove (17), the rinsing end stop (20) defining the open position of the blocking member (05).

6. The cleaning device according to claim 3, characterized in that the attachment groove (17) has one recess for each fixing protrusion (16) by means of which the fixing protrusions (16) are removed from and inserted into the attachment groove (17).

7. The cleaning device according to claim 3, characterized in that the blocking member (05) is adjustable into an assembly position, the fixing protrusions (16) being disengageable from the attachment groove (17) when the blocking member is disposed in the assembly position.

8. The cleaning device according to claim 3, characterized in that at least one assembly stop (22) is formed on the attachment groove (17), the assembly stop (22) defining the assembly position of the blocking member (05) in which the fixing protrusions (16) are removed from and inserted into the attachment groove (17).

9. The cleaning device according to claim 1, characterized in that several vertical nozzles (06) and/or horizontal nozzles (07) are provided on the rinsing rod (03) for jointly cleaning the bottom surface of the food vessel, each vertical nozzle (06) and/or horizontal nozzle (07) being assigned one section of the blocking member (05) by means of which cleaning liquid is prevented from exiting through the assigned vertical nozzles (06) and/or horizontal nozzles (07) by disposing the blocking member (05) in the blocking position, and each vertical nozzle (06) and/or horizontal nozzle (07) being assigned one recess (21) in the blocking member (05) which opens the vertical nozzles (06) and/or horizontal nozzles (07) by disposing the blocking member (05) in the open position.

10. The cleaning device according to claim 1, characterized in that an actuating element (19) for manual adjustment between the blocking position and the open position is provided on the blocking member (05).

11. The cleaning device according to claim 1, characterized in that the blocking member (05) is detachably mounted on the rinsing rod (03).

* * * * *